US010201984B2

(12) United States Patent
Monclus Velasco et al.

(10) Patent No.: US 10,201,984 B2
(45) Date of Patent: Feb. 12, 2019

(54) PRINTING SYSTEM

(71) Applicant: HEWLETT-PACKARD DEVELOPMENT COMPANY, L.P., Houston, TX (US)

(72) Inventors: Antonio Monclus Velasco, Barcelona (ES); David Toussaint, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/113,603

(22) PCT Filed: Jan. 31, 2014

(86) PCT No.: PCT/EP2014/051912

§ 371 (c)(1),
(2) Date: Jul. 22, 2016

(87) PCT Pub. No.: WO2015/113623

PCT Pub. Date: Aug. 6, 2015

(65) Prior Publication Data

US 2017/0008307 A1 Jan. 12, 2017

(51) Int. Cl.
*B41J 2/165* (2006.01)
*B41J 11/00* (2006.01)
(Continued)

(52) U.S. Cl.
CPC ..... *B41J 11/002* (2013.01); *B41J 11/42* (2013.01); *B41J 15/04* (2013.01)

(58) Field of Classification Search
None
See application file for complete search history.

(56) References Cited

U.S. PATENT DOCUMENTS 5,303,015 A * 4/1994 Sato ..... G03G 15/2003 219/216
5,436,709 A 7/1995 Sakaizawa et al.
(Continued)

FOREIGN PATENT DOCUMENTS

CN 101426655 5/2009
CN 102314143 1/2012
(Continued)

OTHER PUBLICATIONS

Yanabe, et al. Wrinkle occurring process of a paper fed to a fixing roller unit in printers and copiers.

*Primary Examiner* — Alejandro Valencia
(74) *Attorney, Agent, or Firm* — HP Inc. Patent Department

(57) ABSTRACT

According to one example, there is provided a printing system. The printing system comprises a print engine to print a print job on media in a print zone, a heating module to apply heat to media in a heating zone and a media handling system to move media through a media path comprising the print zone and the heating zone. The system further comprises a controller to determine when a printing operation is stopped, and when it is so determined to control the heating module to stop heating and to control the media handling system to continue advancing media through the media path until a predetermined condition is met.

20 Claims, 3 Drawing Sheets

(51) Int. Cl.
*B41J 11/42* (2006.01)
*B41J 15/04* (2006.01)

(56) References Cited

U.S. PATENT DOCUMENTS

| | | | | |
|---|---|---|---|---|
| 5,659,844 | A | 8/1997 | Fujiwara | |
| 5,915,146 | A * | 6/1999 | Kusaka | G03G 15/2003 219/216 |
| 6,018,140 | A | 1/2000 | Hirose et al. | |
| 7,065,901 | B2 | 6/2006 | de Vroome | |
| 2002/0008746 | A1 * | 1/2002 | Naniwa | B41J 2/06 347/89 |
| 2011/0123203 | A1 | 5/2011 | Kikuchi | |
| 2012/0182343 | A1 | 7/2012 | Biglari | |
| 2013/0099046 | A1 | 4/2013 | Izumi et al. | |

FOREIGN PATENT DOCUMENTS

| | | |
|---|---|---|
| EP | 1652680 | 5/2006 |
| EP | 2428364 | 3/2012 |
| EP | 2532497 | 12/2012 |
| JP | H06250541 | 9/1994 |
| JP | 2001187472 | 7/2001 |

* cited by examiner

PRINTING SYSTEM

BACKGROUND

Many industrial type printers use heating systems to dry, cure, or fuse printing material that they deposit on a media. Many industrial printing systems print on rolls or webs of media.

It is generally useful to operate industrial printers on a continuous, or at least a near-continuous, basis as this helps maximize printer throughput, and also avoids problems related to stopping and starting different elements of such printers.

BRIEF DESCRIPTION

Examples of the invention will now be described, by way of non-limiting example only, with reference to the accompanying drawings, in which.

DETAILED DESCRIPTION

Figure 1:
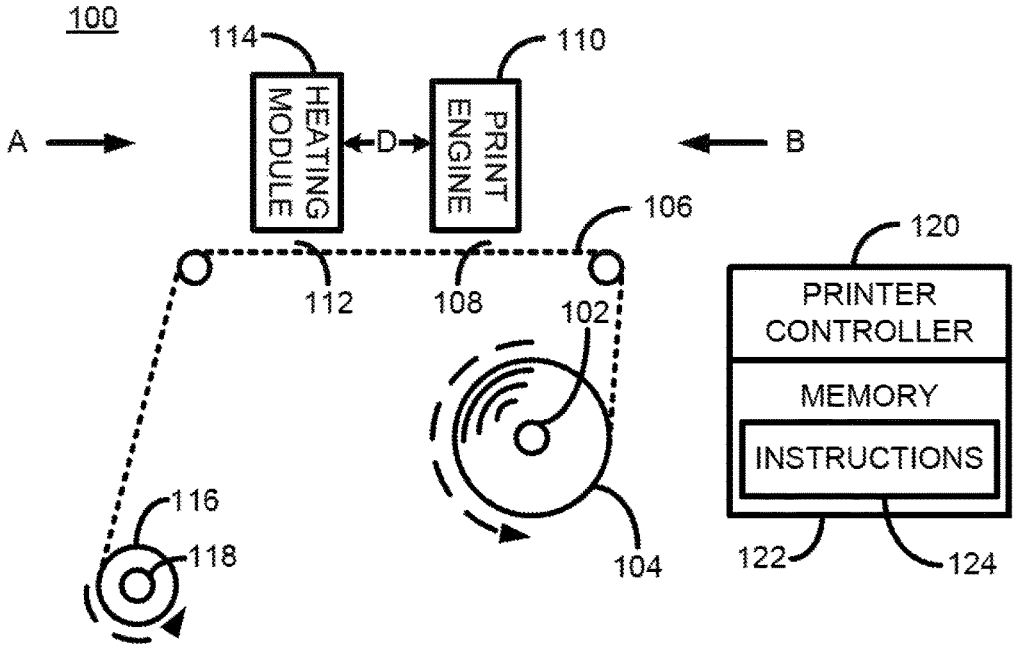
FIG. 1 is a simplified illustration showing a side-view of a printing system according to one example.

Referring now to FIG. 1 there is shown a simplified illustration showing a side-view of a printing system 100 that is configured to print on a web of media. It will be understood that, for reasons of clarity, not all elements of a typical printing system are shown.

The printing system 100 has a front side indicated generally by 'A' and a rear side indicated generally by 'B'. Typically the front side would be the side of the printing system 100 that a user typically interacts with, for example where a display panel or printer control panel is located. The rear side would typically be the side of the printing system 100 that a user interacts with less frequently with, for example, where webs of media may be installed into the printing system.

The printing system 100 comprises a web support 102 onto which may be installed a web or roll of media 104. The media may be any suitable flexible media, such as paper, fabric, vinyl film, etc. The web support 102 may be any suitable web support, such as a spindle onto which the web 104 is inserted, one or multiple support brackets, or the like. In the present example the web support 102 may be powered, for example either directly or indirectly by a motor, to enable the media from the web 104 to be unwound therefrom or to be rewound thereon.

The printing system 100 comprises a media path indicated generally by a dotted line 106. The media path 106 is the path taken by media unwound from the web 104, through a print zone 108 and a heating zone 112, and onto a take-up roll 116.

The take-up roll 116 may be installed on a suitable support 118. The take-up roll 116 and web support 104 collectively form a media handling system that enables media to be advanced or rewound through the media path 106. Although not shown in FIG. 1, the media handling system may, in some examples, include one or multiple rollers, media guides, star wheels, belts, or other media handling elements.

It will be understood that in different examples the media path may be substantially different from the simplified media path shown in FIG. 1.

A print engine 110 may deposit printing material, such as ink, toner, or other printing fluids, on media in the print zone 108 to generate printed content on the media. In one example the print engine comprises printhead, such as a thermal or piezo inkjet printhead. In another example a dry-powder toner print engine may be used, although in other examples other kinds of suitable print engines may be used.

A heating module 114 may be used to apply heat to media positioned in the heating zone 112. For example, the heating module 114 may be used, in different examples, to dry deposited printing material, to cure deposited printing material, to dry and cure deposited printing material, or to fuse deposited printing material. In one example the heating module 114 may be an infrared heating module. In another example the heating module 114 may be a convection heating module. In a further example the heating module may be a forced air heating module, for example that uses impinging jets of hot air to apply heat to a media.

The heating modules, such as the heating module 114 may have a significant amount of thermal inertia. Thus, heating modules generally require some time to heat up to their operating temperature, and also require some time to cool down to an ambient temperature. The cool down time may, for example, vary between about 5 and 60 seconds, although it may be shorter or longer depending on the nature of the heating module.

In one example, the heating module 114 may output heat at around 90 to 120 degrees Celsius, whereas in other examples the heating module 114 may output heat at a higher or lower temperature. The temperature at which the heating module 114 outputs heat may depend, for example, on the type of media or the type of printing material being used.

The print engine 110 and the heating module 114 are separated by a distance D, which in one example may in the order of 10 to 20 cm, although in other examples the distance may be higher or lower.

In one example the take-up roll support 118 is powered to drive media from the web 104, through the media path 106 and to wind media on which printed content has been printed onto the take-up roll 116.

The printing system 100 is generally controlled by a printer controller 120. In the example shown in FIG. 1 the controller 120 is a microprocessor-based controller that is coupled to a memory 122, for example via a communications bus (not shown). The memory 122 stores processor executable instructions 124. The controller 120 may execute the instructions 124 and hence control the operation of the system 100 in accordance with those instructions, as described herein.

Generally, the printer 100 prints content on the media 104 in accordance with a print job obtained by the printer controller 120. A print job comprises data that represents printed content to be printed. A print job may also comprise additional data such as a media size on which the content to be printed is to be printed. When printed on a web of media, the media size may be used by the printer controller 120 to control the length of media to be used to print a print job.

When a print job is to be printed by the printing system 100 the printer controller 120 activates the heating module 114 and waits for it to output heat at the desired temperature. Once this occurs, the printer controller 120 controls the print engine 110 to deposit printing material on media 104 (in accordance with print job data) and controls the take-up roll support 118 to advance media through the print zone 108 and heating zone 112. In operation, media upstream of the print engine 110 (i.e. media which has not yet passed through the print zone 108) will be at ambient temperature, whereas media in the heating zone 112 will be at, or substantially at, the output temperature of the heating module 114. Media which has exited the heating zone 112 will be at a temperature somewhere between the temperature of the heating zone 112 and ambient temperature depending on the length of time since the media exited the heating zone 112.

It is well known that media expands when heated. Some media may, for example, expand in the region of about 5 to 10%. Other media may expand by a greater or lesser amount. For small widths of media, for example widths of less than about 20 to 30 cm, any thermally-related expansion may be considered negligible. However, in wide-format printers, where the media width may be between about 30 and 500 cm, the effects of any thermally related media expansion may become more noticeable.

Figure 2:
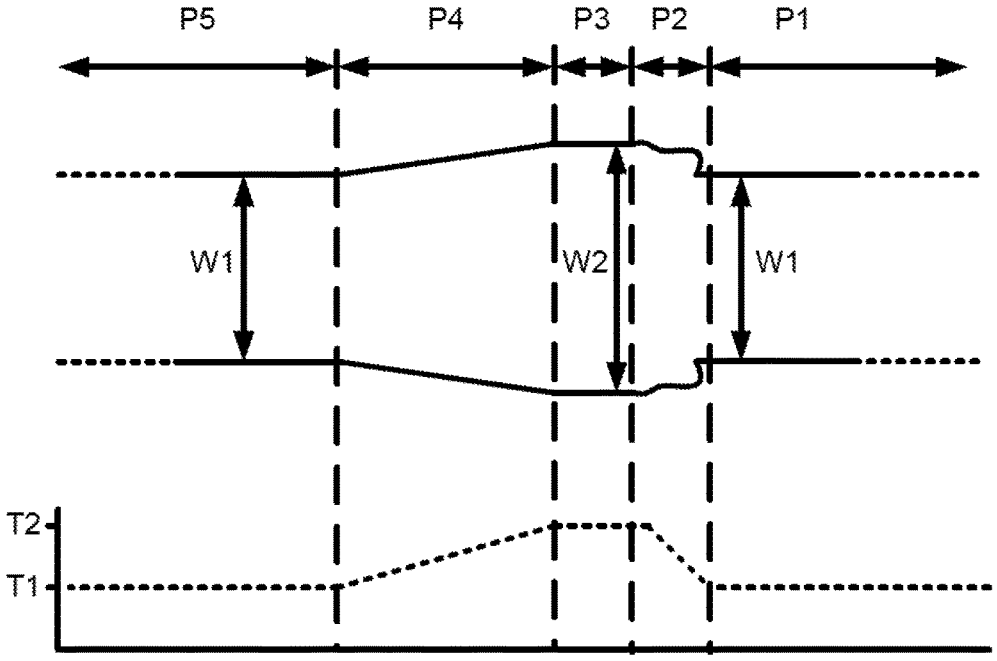
FIG. 2 is a diagram illustrating the change in width of a media and changes in temperature of the media, according to one example.

When a printing system such as printing system 100 is operating and the heating module 114 is at its operating temperature different portions of media in the media path 106 will be at different temperatures, as illustrated in FIG. 2. Due to thermal expansion of media, different portions of the media may also have different widths.

The upper portion of FIG. 2 shows a plan view illustrating example changes in the width of a media in the print path 106, whilst the lower portion of FIG. 2 illustrates the temperature of the media.

A first media portion $P_1$ of media yet to enter the heating zone 112 will be substantially at ambient temperature $T_1$ and will have a width $W_1$. A third media portion $P_3$ within the heating zone will be at a temperature $T_2$ that is higher than the temperature $T_1$. Due to thermal expansion of the media, the width of the third media portion $P_3$ is $W_2$.

A second media portion $P_2$, intermediate media portions $P_1$ and $P_3$, will have a temperature somewhere between $T_1$ and $T_2$. The temperature difference between $T_1$ and $T_2$, may cause deformation of the media, for example in the form of wrinkles, in the media at portion $P_2$. However, during operation of the printing system 100 the media is under tension and is travelling away from the print engine such that wrinkles are either prevented from forming, or from significantly forming, due to the media tension, or are moved away from the print zone 108 where they could cause print quality issues or damage to the print engine 110.

A fourth portion $P_4$ of media having exited the heating zone 112 will have a temperature somewhere between temperature $T_2$ and temperature $T_1$. For example, the portion of $P_4$ just exiting the heating zone 112 will have a temperature $T_2$, whereas the portion of $P_4$ furthest from the heating zone will be at ambient temperature $T_2$ after having cooled down. Between the two extremities of media portion $P_4$ the temperature will be somewhere between $T_2$ and $T_1$. A fifth media portion $P_5$ will be at ambient temperature $T_1$.

To maximize throughput of the printing system 100 printing system operators typically queue multiple print jobs to be printed. In this way, when a current print job has been printed the printing system 100 may immediately, or substantially immediately, start printing a subsequent print job in a continuous or quasi-continuous manner.

In some situations, however, there may be a delay between printing consecutive print jobs. For example, this can occur when no further print jobs are available in a print queue, if a printer performs a maintenance operation between two print jobs, if a user pauses printing to replace an ink cartridge, or for various other reasons. Between print jobs the media and heating module are stopped.

Even if the heating module 114 is stopped when no printing operations are taking place, due to the thermal inertia of the heating module 114 it may take some time to cool down. Consequently, when there is a delay between printing two print jobs and the media is stopped, media outside of the heating zone 112 may deform and wrinkles, for example, may propagate to the print zone 108. As previously mentioned, this may cause image quality problems, such as smudging or smearing, or could cause damage to the print engine 110.

This may be particularly problematic when the print zone and heat zone are in close proximity to one another.

According to one example, the printer controller 120 controls the operation of the printing system 100 so as to reduce, or even eliminate, problems related to media deformation when stopping a printing system having a heating module, such as the printing system 100.

Figure 3:
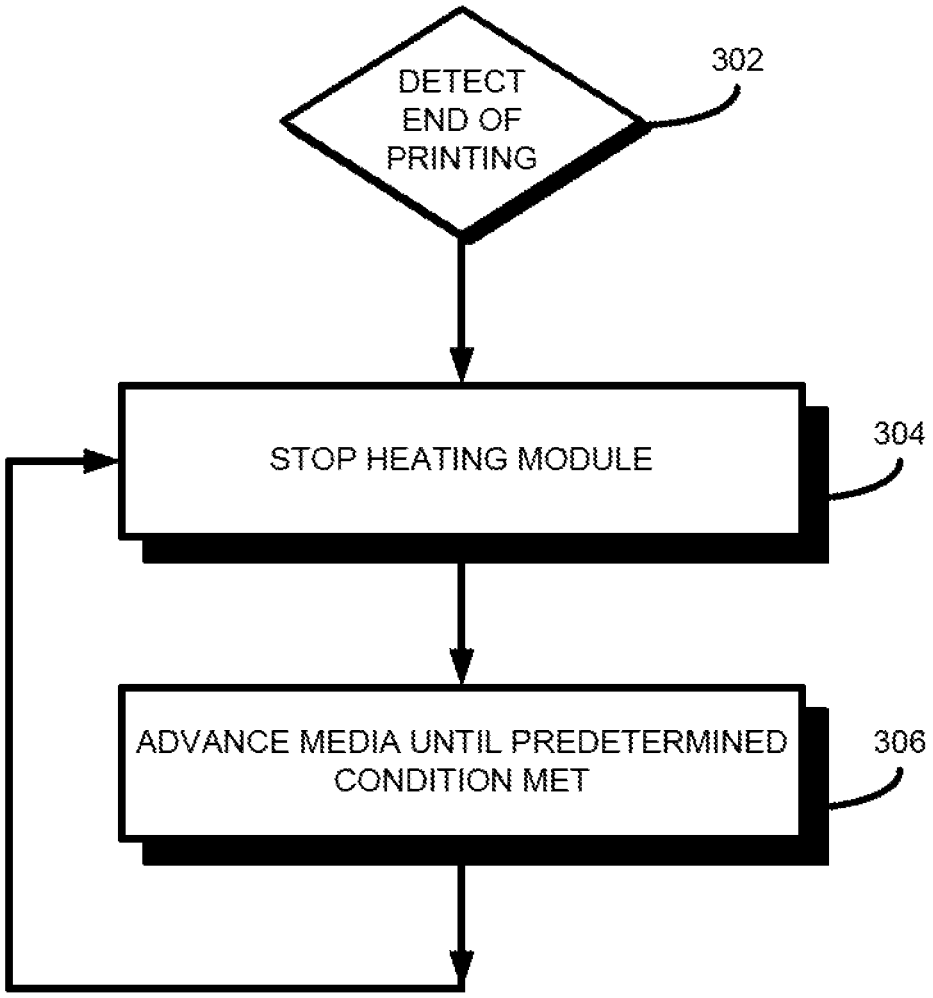
FIG. 3 is a flow diagram outlining an example method of controlling a printing system according to one example.

Referring now to FIG. 3, there is shown a flow diagram outlining an example method of controlling the printing system 100 according to one example.

At block 302 the controller 120 detects or determines when the printing system 100 has stopped printing. This may occur, for example, when printing of a print job has completed, or it may occur, for example, if the printing system 100 is interrupted by a user or due to some other event.

At block 304 the controller 120 controls the heating module 114 to stop generating heat. In one example this may be achieved by the controller 120 cutting power to the heating module 114.

At block 306 the controller 120 controls the take-up roll support 118 to advance media through the media path 106 until a predetermined condition is met. The media is advanced through the media path 106 without any printing operations taking place.

In one example the predetermined condition may be met when a predetermined length of media has been advanced through the media path 106. In one example a length of media in the range of about 30 to 60 cm may be advanced through the media path. The length may be determined based, for example, on the speed at which the media is advanced through the media path and on the rate of cooling of the heating module 114.

In another example the predetermined condition may be met when the temperature of the heating module 114, or the output thereof, is below a predetermined temperature. In another example the predetermined condition may be met when the temperature in the heating zone 112 is below a predetermined temperature. The temperature may be obtained by the controller from any appropriately positioned temperature sensor (not shown).

In one example, during a printing operation the temperature of the heating module 114, or of the output thereof, may be in the region of about 80 to 120 Celsius. In one example the predetermined condition may be met when the temperature is in the region of about 40 to 60 Celsius. In other examples other temperatures may be chosen below which none or little media deformation is expected to arise.

In one example the controller 120 controls the media to be advanced through the media path 106 at a slower speed than the average speed media is advanced through the media path 106 during a normal printing operation. In one example the controller 120 controls the media to be advanced through the media path 106 at the same speed as during a normal printing operation. In one example the controller 120 controls the media to be advanced through the media path 106 at a higher speed than during a normal printing operation. The speed may be determined based, for example, on properties of the media 104. For example, paper media may be able to be advanced at a slower speed that vinyl film media. In one example media may be advanced at about 0.5 inches per second (IPS). In other examples media may be advanced at a higher or lower speed.

As media is advanced through the media path 106 the temperature of the heating module 114 reduces as it cools. Advancing the media thus helps prevent a sharp temperature difference existing between media in the heating zone 112 and media yet to enter the heating zone 112. Consequently, this may reduce, or may even eliminate, media deformation due to sharp temperature gradients. A small amount of media may, however, be wasted during such an operation.

Figure 4:
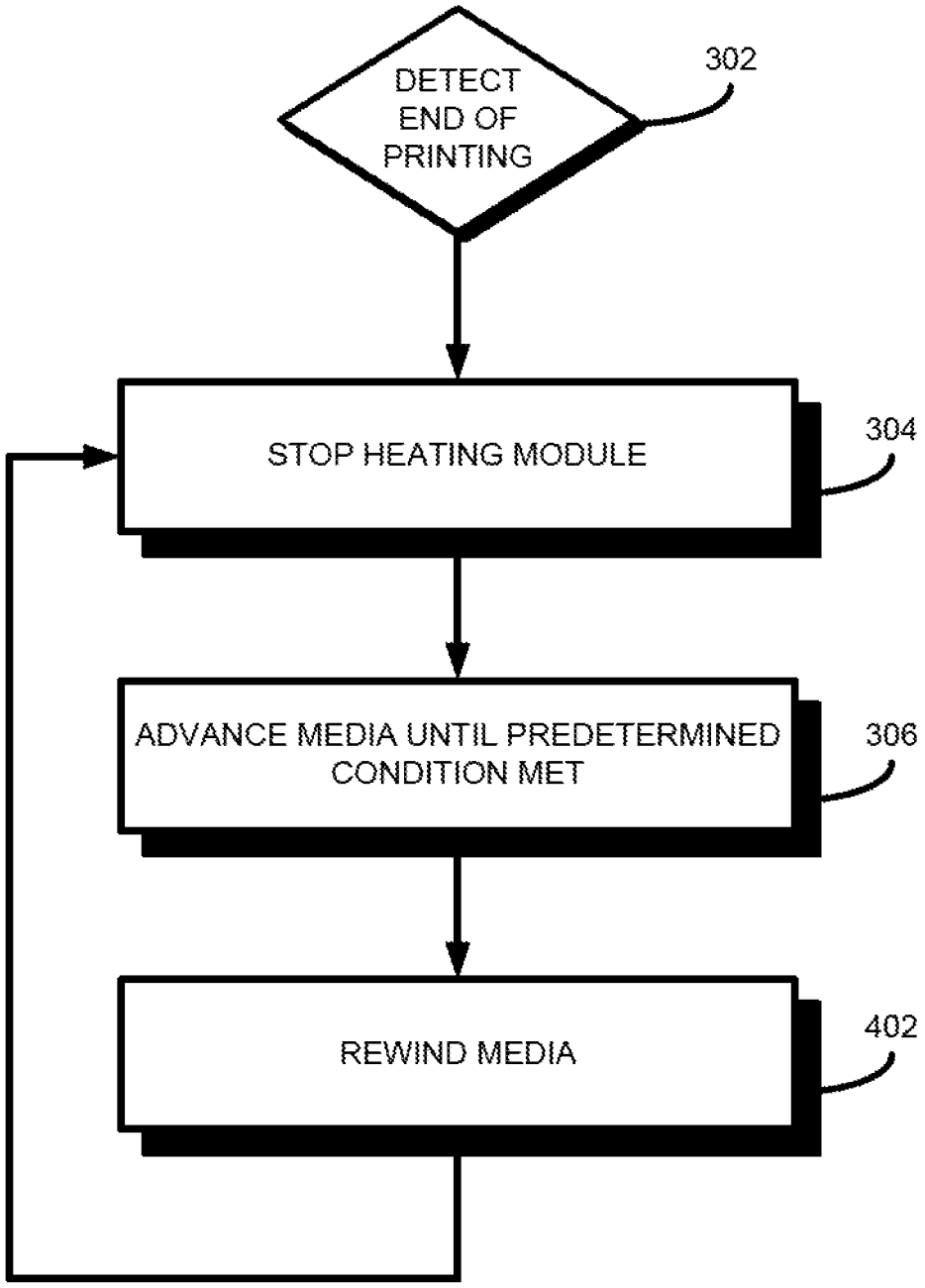
FIG. 4 is a flow diagram outlining an example method of controlling a printing system according to one example

In a further example, as shown in FIG. 4, the controller 120 controls the printing system 100 as described above. At block 402 the controller 120 controls the web support 102 to rewind a predetermined length of media onto the web of media 104 so as to reduce the amount of media wasted.

In one example, the amount of media rewound onto the web of media 104 may be the same as the length of media that was advanced through the media path 106 whilst the heating module 114 was cooling.

However, media which has been previously heated may perform differently from media which has not been previously heated, and visual differences may be observable if part of an image is printed on previously heated media and part of the image is printed on previously unheated media. Accordingly, in one example, the amount of media that is rewound onto the web of media 104 is based on the estimated or expected size on the next image to be printed on the media. For example, in a printing system that is used to generally print A4 sized images on the web of media, the amount of media that is rewound would correspond to the length of an A4 sheet of media. In this way, the subsequent image to be printed should be printed completely on media that has been previously heated. This may thus help reduce any of the potential image quality problems mentioned above.

In a further example, the controller 120 controls the media advance and media rewind operations to attempt to ensure that the length of rewound media is heated to substantially the same amount. For example, if the output of the heating module is 120 Celsius when it is stopped and an acceptable temperature is 60 Celsius, the controller 120 may advance media (block 306) through the media path until the output temperature is 90 Celsius, and may then rewind (block 402) the same length of media as was advanced until the output temperature is 60 Celsius. Depending on the cooling characteristics of the heating module 114, the controller 120 may vary the speed of the media advance and the speed of the media rewind such that each portion of the media is heated to the same amount.

It will be appreciated that examples described herein can be realized in the form of hardware, or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein. Accordingly, some examples provide a program comprising code for implementing a system or method as described herein and a machine readable storage storing such a program.

All of the features disclosed in this specification (including any accompanying claims, abstract and drawings), and/or all of the steps of any method or process so disclosed, may be combined in any combination, except combinations were at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A printing system comprising:

a print engine to print a print job on media in a print zone;

a heating module to apply heat to media in a heating zone;

a media handling system to move media through a media path comprising the print zone and the heating zone; and a controller to: determine when a printing operation is stopped, and when it is so determined: control the heating module to stop heating; and control the media handling system to continue advancing media through the media path until a predetermined condition is met, wherein the controller is to control the media handling system to continue advancing media through the media path until the output temperature of the heating module is below a predetermined temperature.

2. A printing system comprising:

a print engine to print a print job on media in a print zone;

a heating module to apply heat to media in a heating zone;

a media handling system to move media through a media path comprising the print zone and the heating zone; and a controller to: determine when a printing operation is stopped, and when it is so determined: control the heating module to stop heating; and control the media handling system to continue advancing media through the media path until a predetermined condition is met, wherein the controller is to control the media handling system to continue advancing media through the media path until a predetermined length of media has been advanced at a predetermined speed through the media path, wherein the predetermined length is based upon the predetermined speed and a rate of cooling of the heating module.

3. The printing system of claim 1, wherein the controller is to control the media handling system to continue advancing media through the media path at a speed slower than the average speed media is advanced through the media path during a printing operation.

4. A printing system comprising:

a print engine to print a print job on media in a print zone;

a heating module to apply heat to media in a heating zone;

a media handling system to move media through a media path comprising the print zone and the heating zone; and a controller to: determine when a printing operation is stopped, and when it is so determined: control the heating module to stop heating; and control the media handling system to continue advancing media through the media path until a predetermined condition is met, wherein the controller is to control the media handling system to continue advancing media through the media path until the output temperature of the heating module is below a predetermined temperature, wherein the controller is further to control the media handling system to rewind a length media through the media path, the length corresponding to the predetermined length that was advanced through the media path after the controller controlled the heating module to stop heating.

5. A printing system comprising:

a print engine to print a print job on media in a print zone;

a heating module to apply heat to media in a heating zone;

a media handling system to move media through a media path comprising the print zone and the heating zone; and a controller to: determine when a printing operation is stopped, and when it is so determined: control the heating module to stop heating; and control the media handling system to continue advancing media through the media path until a predetermined condition is met, wherein the controller is to control the media handling system to continue advancing media through the media path until the output temperature of the heating module is below a predetermined temperature, wherein the controller is further to control the media handling system to rewind a length media through the media path, the length corresponding to the expected length of the next print job to be printed.

6. The printing system of claim 4, wherein the controller is further to control the media handling system to advance and rewind the media through the media path such that that length of advanced and rewound media is heated by a substantially equal amount.

7. The printing system of claim 1, wherein the media handling system comprises:

a web support; and a take-up roll, wherein the web support and the take-up roll supply a continuous span of media continuously extending through the media path, opposite to both the print engine and the heating module.

8. The printing system of claim 1, wherein the continued advancement of the media through the media path until a predetermined condition is met comprises advancement of the media through the media path relative to and across the heating module.

9. The printing system of claim 1, wherein the continued advancement of the media through the media path until a predetermined condition is met comprises advancement of the media through the media path through the heating zone.

10. The printing system of claim 1, wherein the predetermined condition is based upon a time at which the controller stopped heating with the heating module.

11. The printing system of claim 1, wherein the determination of when a printing operation is stopped comprises determining that printing within the print zone has been stopped.

12. The printing system of claim 1, wherein the determining of when a printing operation is stopped comprises determining the completion of a print job independent of any sensed temperature.

13. The printing system of claim 1, wherein the determining of when a printing operation is stopped comprises determining a user invoked interruption of printing.

14. The printing system of claim 1, wherein the continued advancement of the media through the media path until a predetermined condition is met comprises advancement of the media through the media path relative to and across the heating module.

15. The printing system of claim 1, wherein the determining of when a printing operation is stopped comprises determining the completion of a print job independent of any sensed temperature.

16. The printing system of claim 1, wherein the determining of when a printing operation is stopped comprises determining a user invoked interruption of printing.

17. The printing system of claim 2, wherein the media handling system comprises:

a web support; and a take-up roll, wherein the web support and the take-up roll supply a continuous span of media continuously extending through the media path, opposite to both the print engine and the heating module.

18. The printing system of claim 2, wherein the continued advancement of the media through the media path until a predetermined condition is met comprises advancement of the media through the media path relative to and across the heating module.

19. The printing system of claim 1, wherein the predetermined temperature is less than 60° C.

20. A printing system comprising:

a print engine to print a print job on media in a print zone;

a heating module to apply heat to media in a heating zone;

a media handling system to move media through a media path comprising the print zone and the heating zone; and a controller to: determine when a printing operation is stopped, and when it is so determined: control the heating module to stop heating; and control the media handling system to continue advancing media through the media path until a predetermined condition is met, wherein the controller is to control the media handling system to continue advancing media through the media path at a speed slower than the average speed media is advanced through the media path during a printing operation.

* * * * *